US011495377B2

(12) United States Patent
Amano et al.

(10) Patent No.: US 11,495,377 B2
(45) Date of Patent: Nov. 8, 2022

(54) SOFT MAGNETIC ALLOY AND MAGNETIC COMPONENT

(71) Applicant: TDK CORPORATION, Tokyo (JP)

(72) Inventors: Hajime Amano, Tokyo (JP); Akihiro Harada, Tokyo (JP); Kenji Horino, Tokyo (JP); Hiroyuki Matsumoto, Tokyo (JP); Kazuhiro Yoshidome, Tokyo (JP); Akito Hasegawa, Tokyo (JP); Kensuke Ara, Tokyo (JP); Masakazu Hosono, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 16/971,338

(22) PCT Filed: Feb. 15, 2019

(86) PCT No.: PCT/JP2019/005513

§ 371 (c)(1),
(2) Date: Aug. 20, 2020

(87) PCT Pub. No.: WO2019/163660

PCT Pub. Date: Aug. 29, 2019

(65) Prior Publication Data

US 2021/0020342 A1 Jan. 21, 2021

(30) Foreign Application Priority Data

Feb. 21, 2018 (JP) ..... JP2018-028911

(51) Int. Cl.
*H01F 1/153* (2006.01)
*C22C 45/00* (2006.01)

(52) U.S. Cl.
CPC ..... *H01F 1/15333* (2013.01); *C22C 45/008* (2013.01); *C22C 2200/02* (2013.01); *C22C 2202/02* (2013.01)

(58) Field of Classification Search
None
See application file for complete search history.

(56) References Cited

U.S. PATENT DOCUMENTS

2018/0218812 A1 8/2018 Harada et al.

FOREIGN PATENT DOCUMENTS

| | | | | |
|---|---|---|---|---|
| CN | 104934179 A | | 9/2015 | |
| JP | 09213514 A | * | 8/1997 | ..... H01F 1/153 |
| JP | 2002-322546 A | | 11/2002 | |
| JP | 6226094 B1 | | 11/2017 | |

OTHER PUBLICATIONS

English language machine translation to JP-09213514-A. Generated Feb. 22, 2022. (Year: 2022).*
Aug. 27, 2020 International Preliminary Report on Patentability issued in International Patent Application No. PCT/JP2019/005513.

* cited by examiner

*Primary Examiner* — Brian D Walck
(74) *Attorney, Agent, or Firm* — Oliff PLC

(57) ABSTRACT

Provided is a soft magnetic alloy which has high saturation flux density and low coercivity and is represented by the compositional formula $(Fe_{(1-(\alpha+\beta))}X1_{\alpha}X2_{\beta})_{(1-(a+b+c+d+e+f))}M_aP_bSi_cCu_dX3_eB_f$, wherein X1 is at least one element selected from the group consisting of Co and Ni, X2 is at least one element selected from the group consisting of Ti, V, Mn, Ag, Zn, Al, Sn, As, Sb, Bi, and rare earth elements, X3 is at least one element selected from the group consisting of C and Ge, and M is at least one element selected from the group consisting of Zr, Nb, Hf, Ta, Mo, and W, and wherein $0.030 \leq a \leq 0.120$, $0.010 \leq b \leq 0.150$, $0 \leq c \leq 0.050$, $0 \leq d \leq 0.020$, $0 \leq e \leq 0.100$, $0 \leq f \leq 0.030$, $\alpha \geq 0$, $\beta \geq 0$, and $0 \leq \alpha+\beta \leq 0.55$.

14 Claims, No Drawings

SOFT MAGNETIC ALLOY AND MAGNETIC COMPONENT

TECHNICAL FIELD

The present invention relates to a soft magnetic alloy and a magnetic component.

BACKGROUND

Recently, a nano-crystal material has become a main stream as a soft magnetic material for magnetic component, particularly as a soft magnetic material for power inductor. For example, Patent Document 1 discloses an Fe-based soft magnetic alloy having fine grain size. The nano-crystal material attains a higher saturation magnetic flux density and the like compared to a conventional crystal material such as FeSi and an amorphous based material such as FeSiB and the like.

However, currently, the magnetic component, particularly the power inductor, has adapted to a higher frequency and also has become more compact; thus a soft magnetic alloy capable of obtaining a magnetic core with a higher DC superimposition property and a lower core loss (magnetic loss) is in demand.

[Patent Document 1] JP Patent Application Laid Open No. 2002-322546

SUMMARY

Note that, as a method for reducing a core loss of the above-mentioned magnetic core, it has been considered to decrease a coercive force particularly of the magnetic body constituting the magnetic core. Also, as a method of obtaining a high DC superimposition property, it has been considered to increase a saturation magnetic flux density particularly of the magnetic body constituting the magnetic core.

The object of the present invention is to provide a soft magnetic alloy and the like having a high saturation magnetic flux density and a low coercive force.

In order to attain the above object, the soft magnetic alloy according to the present invention is a soft magnetic alloy represented by a compositional formula $(Fe_{(1-(\alpha+\beta))}X1_{\alpha}X2_{\beta})_{(1-(a+b+c+d++e+f)}M_aP_bSi_cCu_dX3_eB_f$, in which X1 represents one or more selected from a group consisting of Co and Ni, X2 represents one or more selected from a group consisting of Ti, V, Mn, Ag, Zn, Al, Sn, As, Sb, Bi, and rare earth elements, X3 represents one or more selected from a group consisting of C and Ge, M represents one or more selected from a group consisting of Zr, Nb, Hf, Ta, Mo, and W, $0.030 \le a \le 0.120$, $0.010 \le b \le 0.150$, $0 \le c \le 0.050$, $0 \le d \le 0.020$, $0 \le e \le 0.100$, $0 \le f \le 0.030$, $\alpha \ge 0$, $\beta \ge 0$, and $0 \le \alpha+\beta \le 0.55$ are satisfied.

By satisfying the above-mentioned characteristics, the soft magnetic alloy according to the present invention tends to easily attain a structure which easily becomes a Fe-based nanocrystal alloy by performing a heat treatment. Further, the Fe-based nanocrystal alloy satisfying the above-mentioned characteristics becomes a soft magnetic alloy having preferable soft magnetic properties which are a high saturation magnetic flux density and a low coercive force.

The soft magnetic alloy according to the present invention may satisfy $b \ge c$.

The soft magnetic alloy according to the present invention may satisfy $0 \le f \le 0.010$.

The soft magnetic alloy according to the present invention may satisfy $0 \le f \le 0.001$.

The soft magnetic alloy according to the present invention may satisfy $0.730 \le 1-(a+b+c+d+e+f) \le 0.930$.

The soft magnetic alloy according to the present invention may satisfy $0 \le \alpha\{1-(a+b+c+d+e+f)\} \le 0.40$.

The soft magnetic alloy according to the present invention may satisfy $\alpha=0$.

The soft magnetic alloy according to the present invention may satisfy $0 \le \{1-(a+b+c+d+e+f)\} \le 0.030$.

The soft magnetic alloy according to the present invention may satisfy $\beta=0$.

The soft magnetic alloy according to the present invention may satisfy $\alpha=\beta=0$.

The soft magnetic alloy according to the present invention may have a nano-hetero structure in which initial fine crystals exist in an amorphous.

In the soft magnetic alloy according to the present invention, an average grain size of the initial fine crystals may be 0.3 to 10 nm.

The soft magnetic alloy according to the present invention may have a structure made of Fe-based nanocrystals.

In the soft magnetic alloy according to the present invention, an average grain size of the Fe-based nanocrystals may be 5 to 30 nm.

The soft magnetic alloy according to the present invention may be a thin ribbon form.

The soft magnetic alloy according to the present invention may be a powder form.

Also, a magnetic component according to the present invention is made of the above-mentioned soft magnetic alloy.

DETAILED DESCRIPTION

Hereinafter, an embodiment of the present invention is described.

The soft magnetic alloy according to the present embodiment is a soft magnetic alloy represented by a compositional formula $(Fe_{(1-(\alpha+\beta))}X1_{\alpha}X2_{\beta})_{(1-(a+b+c+d+e+f)}M_aP_bSi_cCu_dX3_eB_f$, in which X1 represents one or more selected from a group consisting of Co and Ni, X2 represents one or more selected from a group consisting of Ti, V, Mn, Ag, Zn, Al, Sn, As, Sb, Bi, and rare earth elements, X3 represents one or more selected from a group consisting of C and Ge, M represents one or more selected from a group consisting of Zr, Nb, Hf, Ta, Mo, and W, $0.030 \le a \le 0.120$, $0.010 \le b \le 0.150$, $0 \le c \le 0.050$, $0 \le d \le 0.020$, $0 \le e \le 0.100$, $0 \le f \le 0.030$, $\alpha \ge 0$, $\beta \ge 0$, and $0 \le \alpha+\beta \le 0.55$ are satisfied.

The soft magnetic alloy having the above composition tends to easily become a soft magnetic alloy made of an amorphous and not including crystal phases made of crystal having a grain size larger than 15 nm. Further, in case the soft magnetic alloy is heat treated, Fe-based nanocrystals tend to easily precipitate. Also, the soft magnetic alloy including the Fe-based nanocrystals tend to easily attain a high saturation magnetic flux density and a low coercive force.

In other words, the soft magnetic alloy having the above-mentioned composition tends to be a starting material of the soft magnetic alloy in which the Fe-based nanocrystals are precipitated.

The Fe-based nanocrystal refers to a crystal of which the grain size is nano order and a crystal structure of Fe is bcc (body center cubic structure). In the present embodiment, it is preferable to precipitate the Fe-based nanocrystals having an average grain size of 5 to 30 nm. The soft magnetic alloy in which such Fe-based nanocrystals are precipitated tends to attain a high saturation magnetic flux density and a low coercive force. Also, a resistivity tends to be higher.

Note that, the soft magnetic alloy before the heat treatment may be solely consisted by an amorphous, however, the soft magnetic alloy before the heat treatment preferably includes an amorphous and an initial fine crystal having a grain size of 15 nm or less; and also preferably the soft magnetic alloy has a nano-hetero structure in which the initial fine crystals are in the amorphous. By having the nano-hetero structure in which the initial fine crystals are in the amorphous, the Fe-based nanocrystals tend to easily precipitate during the heat treatment. Note that, in the present embodiment, the initial fine crystals preferably have an average grain size of 0.3 to 10 nm.

Hereinafter, each component of the soft magnetic alloy according to the present embodiment is described.

M is one or more selected from the group consisting of Zr, Nb, Hf, Ta, Mo, and W. Also, M is preferably one or more selected from the group consisting of Nb, Hf, and Zr. As M is one or more selected from the group consisting of Nb, Hf, and Zr; the saturation magnetic flux density tends to easily increase and the coercive force tends to easily decrease.

M content (a) satisfies $0.030 \le a \le 0.120$. M content (a) is preferably $0.050 \le a \le 0.100$. When a is small, the crystal phases made of crystals having an average grain size larger than 15 nm tend to be formed easily in the soft magnetic alloy before the heat treatment; and the Fe-based nanocrystals cannot be precipitated by the heat treatment, thus the coercive force tends to increase easily. When a is large, the saturation magnetic flux density tends to easily decrease.

P content (b) satisfies $0.010 \le b \le 0.150$. P content (b) preferably satisfies $0.018 \le b \le 0.131$, and more preferably $0.026 \le b \le 0.105$. When b is small, the crystal phases made of crystals having an average grain size larger than 15 nm tend to be easily formed in the soft magnetic alloy before the heat treatment; and the Fe-based nanocrystals cannot be precipitated by heat treatment. Thus, the coercive force tends to increase easily and the resistivity tends to decrease easily. When b is large, the saturation magnetic flux density tends to easily decrease.

Si content (c) satisfies $0 \le c \le 0.050$. That is, Si may not be included. Si content (c) preferably satisfies $0.005 \le c \le 0.040$. When c is large, the saturation magnetic flux density tends to easily decrease. Also, when Si is included, the crystal phases made of crystals having an average grain size larger than 15 nm tends to become difficult to form in the soft magnetic alloy before the heat treatment compared to the case without Si.

Further, $b \ge c$ is preferably satisfied. When $b \ge c$ is satisfied, the coercive force particularly tends to easily decrease.

Cu content (d) satisfies $0 \le d \le 0.020$. That is, Cu may not be included. As Cu content decreases, the saturation magnetic flux density increases; and as Cu content increases, the coercive force tends to decrease. When d is large, the crystal phases made of crystals having an average grain size larger than 15 nm tend to be easily formed in the soft magnetic alloy before the heat treatment; and the Fe-based nanocrystals cannot be precipitated by the heat treatment. Thus, the saturation magnetic flux density tends to easily decrease and the coercive force tends to easily increase.

X3 is one or more selected from the group consisting of C and Ge. X3 content (e) tends to satisfy $0 \le e \le 0.100$. That is, X3 may not be included. X3 content (e) is preferably $0 \le e \le 0.050$. When X3 content is too large, the saturation magnetic flux density tends to easily decrease, and the coercive force tends to easily increase.

B content (f) satisfies $0 \le f \le 0.030$. That is, B may not be included. Further, B content (f) preferably satisfies $0 \le f \le 0.010$, and preferably B is substantially not included. Note that, "B is substantially not included" means that B content (f) is $0 \le f < 0.001$. When B content is too large, the saturation magnetic flux density tends to easily decrease and the coercive force tends to easily increase.

Fe content $(1-(a+b+c+d+e+f))$ is not particularly limited, and preferably $0.730 \le 1-(a+b+c+d+e+f) \le 0.930$ is satisfied. Also, $0.780 \le 1-(a+b+c+d+e+f) \le 0.930$ may be satisfied. When the above-mentioned range is satisfied, the saturation magnetic flux density tends to easily improve and the coercive force tends to easily decrease.

Also, in the soft magnetic alloy according to the present embodiment, part of Fe may be substituted by X1 and/or X2.

X1 is one or more selected from the group consisting of Co and Ni. X1 content ($\alpha$) may be $\alpha=0$. That is, X1 may not be included. Also, a number of X1 atoms is preferably 40 at % or less when a number of atoms of entire composition is 100 at %. That is, $0 \le \alpha\{1-(a+b+c+d+e+f)\} \le 0.40$ may be preferably satisfied.

X2 is one or more selected from the group consisting of Ti, V, Mn, Ag, Zn, Al, Sn, As, Sb, Bi, and rare earth elements. X2 content ($\beta$) may be ($\beta=0$. That is X2 may not be included. Also, a number of X2 atoms is preferably 3.0 at % or less when a number of atoms of entire composition is 100 at %. That is, $0 \le \beta\{1-(a+b+c+d+e+f)\} \le 0.030$ may be preferably satisfied.

The amount of X1 and/or X2 substituting Fe may be within a range of $0 \le \alpha+\beta \le 0.55$. When $\alpha$ and $\beta$ are $\alpha+\beta > 0.55$, it becomes difficult to obtain the Fe-based nanocrystal alloy by the heat treatment, and even if the Fe-based nanocrystal alloy is obtained, the coercive force tends to easily increase.

Note that, the soft magnetic alloy according to the present embodiment may include elements other than mentioned in above as inevitable impurities. Also, the elements other than mentioned in above may be included by less than 1 wt % in total with respect to 100 wt % of the soft magnetic alloy.

Hereinbelow, a method for producing the soft magnetic alloy according to the present embodiment is described.

The method for producing the soft magnetic alloy according to the present embodiment is not particularly limited. For example, a method of producing a thin ribbon of the soft magnetic alloy according to the present embodiment by a single roll method may be mentioned. Also, the thin ribbon may be a continuous thin ribbon.

In a single roll method, first, a pure metal of each metal element included in the soft magnetic alloy obtained at the end is prepared. Then, it is weighed so that a same composition as the soft magnetic alloy obtained at the end is obtained. Then, the pure metal of each element is melted and mixed to produce a mother alloy. Note that, a method of melting the pure metal is not particularly limited. For example, a method of melting by high frequency heat after vacuuming the chamber may be mentioned. Note that, the mother alloy and the soft magnetic alloy including the Fe-based nanocrystals obtained at the end has the same composition.

Next, the produced mother alloy is heated and melted to produce a molten metal. A temperature of the molten metal is not particularly limited, and it can be 1200 to 1500° C.

In a single roll method, before the heat treatment which is mainly described in below, the thin ribbon is an amorphous which does not include the crystal having a grain size larger than 15 nm. By performing the heat treatment to the thin ribbon which is an amorphous, the Fe-based nanocrystal alloy can be obtained.

Note that, a thickness of the thin ribbon can be regulated mainly by adjusting a rotational speed of a roll of the thin ribbon of before the heat treatment. Also, for example, a thickness of the thin ribbon can also be regulated by adjusting a space between a nozzle and a roll; and also by adjusting a temperature of the molten metal. The thickness of the thin ribbon is not particularly limited, and for example it can be 5 to 30 μm.

A method of verifying whether the thin ribbon of the soft magnetic alloy before the heat treatment includes the crystal having a grain size larger than 15 nm is not particularly limited. For example, the presence of the crystal having a grain size larger than 15 nm can be verified by usual X ray diffraction analysis.

Also, the thin ribbon before the heat treatment may be completely free of the initial fine crystal having a grain size of less than 15 nm, however the initial fine crystal is preferably included. That is, the thin ribbon before the heat treatment preferably has a nano-hetero structure made of the amorphous and the initial fine crystals which are in the amorphous. Note that, the grain size of the initial fine crystal is not particularly limited, and an average grain size of the initial fine crystals may preferably be 0.3 to 10 nm.

Also, a method for observing the presence of the above-mentioned initial fine crystals and the average grain size of the initial fine crystals is not particularly limited. For example, the presence of the above-mentioned initial fine crystals and the average grain size of the initial fine crystals can be verified by obtaining a selected area diffraction pattern, a nano beam diffraction pattern, a bright field image, or a high resolution image using a transmission electron microscope to a sample which is thinned by an ion milling. In case of using the selected area diffraction pattern and the nano beam diffraction pattern, regarding the diffraction pattern, the amorphous forms a ring shape pattern, and non-amorphous forms diffraction dots which are derived from the crystal structure. Also, in case of using the bright field image or the high-resolution image, the presence of the initial fine crystals and the average grain size of the initial fine crystals can be observed by visual observation under a magnification of $1.00\times10^5$ to $3.00\times10^5$.

A temperature of roll, a rotational speed, and an atmosphere inside the chamber are not particularly limited. The temperature of the roll is preferably 4 to 30° C. to form an amorphous. As the rotational speed of the roll increases, the average grain size of the initial fine crystals tends to decrease, and it is preferably 30 to 40 m/sec in order to obtain the initial fine crystals having an average grain size of 0.3 to 10 nm. The atmosphere inside the chamber is preferably in air considering the cost.

Also, a heat treatment condition for producing the Fe-based nanocrystal alloy is not particularly limited. A preferable heat treatment condition differs depending on the composition of the soft magnetic alloy. Usually, the preferable heat treatment temperature is about 400 to 600° C., and a preferable heat treatment time is about 10 minutes to 10 hours. However, the preferable heat treatment temperature and time may be outside the above-mentioned range depending on the composition. Also, the atmosphere during the heat treatment is not particularly limited. It may be carried out under active atmosphere such as in air, or it may be carried out under inert atmosphere such as in Ar gas or so.

Also, a method of calculating the average grain size of the obtained Fe-based nanocrystal alloy is not particularly limited. For example, the average grain size can be calculated using a transmission electron microscope. Also, a method of verifying bcc (body center cubic structure) of the crystal structure is not particularly limited. For example, the crystal structure can be confirmed using X ray diffraction analysis.

As a method of obtaining the soft magnetic alloy according to the present embodiment, other than the above-mentioned single roll method, for example, a method of obtaining a powder of the soft magnetic alloy according to the present embodiment by a water atomization method or a gas atomization method may be mentioned. Hereinafter, a gas atomization method is described.

In a gas atomization method, a molten metal of temperature range of 1200 to 1500° C. is obtained as same as the above-mentioned single roll method. Then, the molten metal is injected in a chamber, thereby a powder is produced.

Here, by setting a gas injecting temperature to 4 to 30° C. and setting a vapor pressure inside the chamber to 1 hPa or less, the above-mentioned preferable nano-hetero structure tends to be obtained easily.

After producing the powder by a gas atomization method, a heat treatment at 400 to 600° C. for 0.5 to 10 minutes is carried out. Thereby, element diffusion is facilitated while the powder is restricted from sintering with each other and becoming too large, and the powder can reach to a thermodynamic equilibrium in short period of time. Thereby, strain and stress can be removed, and the Fe-based soft magnetic alloy having the average grain size of 10 to 50 nm tends to be easily formed.

Hereinabove, an embodiment of the present invention is described, however the present invention is not limited thereto.

The shape of the soft magnetic alloy according to the present embodiment is not particularly limited. As described in above, a thin ribbon form and a powder form are mentioned as examples, however, other than these, a block form and the like may be mentioned.

The use of the soft magnetic alloy (Fe-based nanocrystal alloy) according to the present embodiment is not particularly limited. For example, magnetic components may be mentioned, and among these, a magnetic core may be particularly mentioned. It can be suitably used as a magnetic core for inductor, particularly for a power inductor. The soft magnetic alloy according to the present embodiment can be suitably used for a thin film inductor, a magnetic head, and the like other than the magnetic core.

Hereinafter, a method of obtaining a magnetic component, particularly a magnetic core and an inductor from the soft magnetic alloy according to the present embodiment is described. However, the method of obtaining the magnetic core and the inductor from the soft magnetic alloy according to the present embodiment is not particularly limited thereto. Also, as the use of the magnetic core, other than the inductor, a transformer, a motor, and the like may be mentioned.

As a method of obtaining the magnetic core from the soft magnetic alloy of a thin ribbon form, for example, a method of winding the soft magnetic alloy of thin ribbon form and a method of stacking the soft magnetic alloy of thin ribbon form may be mentioned. In case of stacking an insulator between the soft magnetic alloys of thin ribbon form, the magnetic core with even more enhanced properties can be obtained.

As a method of obtaining the magnetic core from a powder form soft magnetic alloy, for example, a method of molding using a metal mold after mixing the powder form soft magnetic alloy with a binder may be mentioned. Also, before mixing with the binder, by performing an oxidizing treatment, an insulation coating, and the like to the powder surface, a resistivity improves and the magnetic core suited for even higher frequency range can be obtained.

A method of molding is not particularly limited, and for example, a method of molding using a metal mold, a mold pressing, and the like may be mentioned. A type of the binder is not particularly limited, and a silicone resin may be mentioned. A mixing ratio between the soft magnetic alloy powder and the binder is not particularly limited. For example, 1 to 10 mass % of the binder may be mixed with respect to 100 mass % of the soft magnetic alloy powder.

For example, 1 to 5 mass % of the binder is mixed with respect to 100 mass % of the soft magnetic alloy powder, then press molding is performed using a metal mold. Thereby, the magnetic core having 70% or more of a space factor (powder filling rate), 0.45T or more of a magnetic flux density when $1.6\times10^4$ A/m of magnetic field is applied, and 1 Ω·cm or more of a resistivity can be obtained. The above-mentioned properties are equal or better than a generally known ferrite magnetic core.

Also, for example, 1 to 3 mass % of the binder is mixed with respect to 100 mass % of the soft magnetic alloy. Then, press molding is performed at a temperature higher than the softening point of the binder using a metal mold. Thereby, a dust core having 80% or more of a space factor, 0.9T or more of a magnetic flux density when $1.6\times10^4$ A/m of magnetic field is applied, and 0.1 Ω·cm or more of a resistivity can be obtained. The above-mentioned properties are better than a generally known dust core.

Further, by performing a heat treatment as a strain relief heat treatment after molding into a molded article which forms the above-mentioned magnetic core, a core loss is further decreased and a functionality is enhanced. Note that, the core loss of the magnetic core decreases as the coercive force of the magnetic body constituting the magnetic core decreases.

Also, an inductor component can be obtained by winding a wire around the magnetic core. A method of winding the wire around the core is not particularly limited, and also a method of producing the inductor component is not particularly limited. For example, a method of winding the wire for at least one turn around the magnetic core produced by the above-mentioned method may be mentioned.

Further, in case of using the soft magnetic alloy particle, there is a method of producing an inductor component by press molding the magnetic body while the wound coil is incorporated in the magnetic body. In such case, an inductor component which corresponds to high frequency range and large electric current tend to be easily obtained.

Further, in case of using the soft magnetic alloy particle, the inductor component can be obtained by print stacking a soft magnetic alloy paste and a conductor paste in an alternating manner and then firing may be carried out. The soft magnetic alloy paste is obtained by forming a paste by adding the binder and the solvent to the soft magnetic alloy particle. The conductor paste is obtained by forming a paste by adding the binder and the solvent to a conductor metal for coil. Alternatively, a soft magnetic alloy sheet is produced using the soft magnetic alloy paste, and a conductor paste is printed to the surface of the soft magnetic alloy sheet, then these are stacked and fired. Thereby, the inductor component in which a coil is incorporated in the magnetic body can be obtained.

Here, in case of producing the inductor component using the soft magnetic alloy particle, from the point of obtaining an excellent Q property, it is preferable to use a soft magnetic alloy powder having a maximum grain size by a sieve gauge of 45 μm or less, and a median grain size (D50) of 30 μm or less. In order to have the maximum grain size by a sieve gauge of 45 μm or less, a sieve having a gauge of 45 μm is used, and the soft magnetic alloy powder which passed through the sieve may be only used.

As the soft magnetic alloy powder having large maximum grain size is used more, the Q value under high frequency range tends to decrease. In case the soft magnetic alloy powder having a maximum grain size larger than 45 μm by a sieve gauge is used, the Q value under high frequency range may decrease significantly. Note that, in case the Q value under a high frequency range is not an important factor, then the soft magnetic alloy powder having various sizes can be used. Since the soft magnetic alloy powder having various sizes can be produced at relatively low cost, in case of using the soft magnetic alloy powder having various sizes, a cost can be reduced.

EXAMPLES

Hereinafter, the present invention is described based on examples.

Raw material metals were weighed to obtain an alloy composition of Examples and Comparative examples shown in below Tables, then the raw material metals were melted by high frequency heating, thereby a mother alloy was produced.

Then, the produced mother alloy was heated and melted to form a molten metal of 1300° C., then the molten metal was injected on a roll of 20° C. in air rotating at a rotational speed of 40 m/sec by a single roll method. Thereby, a thin ribbon was formed. A thickness of the thin ribbon was 20 to 25 μm, a width of the thin ribbon was about 15 mm, and a length of the thin ribbon was about 10 m.

The obtained thin ribbon was subjected to X ray diffraction analysis, and a crystal having a grain size larger than 15 nm was verified. In case the crystal having the grain size larger than 15 nm was not found, it was considered that the thin ribbon was made of amorphous phases; and in case the crystal having grain size larger than 15 nm was found, then it was considered that the thin ribbon was made of crystal phases.

Then, to the thin ribbon of Examples and Comparative examples, a heat treatment was performed at 550° C. for 60 minutes. Each thin ribbon after the heat treatment was measured with a saturation magnetic flux density and a coercive force. The saturation magnetic flux density (Bs) was measured using a Vibrating Sample Magnetometer (VSM) at a magnetic field of 1000 kA/m. The coercive force (Hc) was measured using a DC BH tracer at a magnetic field of 5 kA/m. The resistivity (ρ) was measured using a resistivity measurement by a four-point probe method. In the present examples, the saturation magnetic flux density of 1.30 T or more was considered good and 1.50 or more considered even better. The coercive force of 10.0 A/m or less was considered good and 5.0 A/m or less was considered even better. The resistivity (ρ) was evaluated with respect to the resistivity (ρ) of a thin ribbon formed by the same production method as Example 3 except for using $Fe_{90}Zr_7B_3$ (hereinafter, this may be referred as $Fe_{90}Zr_7B_3$ thin ribbon). When the resistivity (ρ) increased by 20% or more and less than 40% with respect to the resistivity of $Fe_{90}Zr_7B_3$ thin ribbon, it was considered good; and when it increased by 40% or more then it was considered even better. In below Tables, when the resistivity (ρ) increased by 40% or more from the resistivity of $Fe_{90}Zr_7B_3$ thin ribbon, it is indicated "Excellent"; when the resistivity (ρ) increased by 20% or more and less than 40% from the resistivity of $Fe_{90}Zr_7B_3$ thin ribbon, it is indicated "Good"; when the resistivity (ρ) was same or increased by less than 20% from the resistivity of $Fe_{90}Zr_7B_3$ thin ribbon, it is indicated "Fair"; and when the resistivity (ρ) lower than the resistivity of $Fe_{90}Zr_7B_3$ thin ribbon it is indicated "Poor". Note that, the result of the resistivity (ρ) does not necessarily have to show excellent result in order to attain the object of the present invention.

Note that, in below shown Examples, unless mentioned otherwise, all Examples were confirmed to have Fe-based nanocrystals having an average grain size of 5 to 30 nm, and a crystal structure of bcc was confirmed by observation using an X ray diffraction analysis and a transmission electron microscope. Also, all of Examples and Comparative examples shown in below Tables did not include X1 and X2 except for Table 19.

TABLE 1

| | $Fe_{(1-(a+b+c))}M_aP_bSi_c$ (d = e = f = 0, α = β = 0) | | | | | | | |
|---|---|---|---|---|---|---|---|---|
| Sample No. | Fe | M (Zr) a | P b | Si c | XRD | Bs (T) | Hc (A/m) | ρ |
| Comparative example 1 | 0.935 | 0.025 | 0.040 | 0.000 | Crystal phase | 1.85 | 322 | Poor |
| Example 1 | 0.930 | 0.030 | 0.040 | 0.000 | Amorphous phase | 1.82 | 9.3 | Fair |
| Example 2 | 0.910 | 0.050 | 0.040 | 0.000 | Amorphous phase | 1.73 | 6.7 | Fair |
| Example 3 | 0.890 | 0.070 | 0.040 | 0.000 | Amorphous phase | 1.64 | 5.3 | Good |
| Example 4 | 0.880 | 0.080 | 0.040 | 0.000 | Amorphous phase | 1.57 | 5.1 | Good |
| Example 5 | 0.860 | 0.100 | 0.040 | 0.000 | Amorphous phase | 1.44 | 5.2 | Good |
| Example 6 | 0.840 | 0.120 | 0.040 | 0.000 | Amorphous phase | 1.31 | 5.6 | Good |
| Comparative example 2 | 0.830 | 0.130 | 0.040 | 0.000 | Amorphous phase | 1.24 | 6.8 | Good |

TABLE 2

| | $Fe_{(1-(a+b+c))}M_aP_bSi_c$ (d = e = f = 0, α = β = 0) | | | | | | | |
|---|---|---|---|---|---|---|---|---|
| Sample No. | Fe | M (Nb) a | P b | Si c | XRD | Bs (T) | Hc (A/m) | ρ |
| Comparative example 3 | 0.895 | 0.025 | 0.080 | 0.000 | Crystal phase | 1.76 | 349 | Fair |
| Example 7 | 0.890 | 0.030 | 0.080 | 0.000 | Amorphous phase | 1.72 | 9.8 | Good |
| Example 8 | 0.870 | 0.050 | 0.080 | 0.000 | Amorphous phase | 1.63 | 7.1 | Good |
| Example 9 | 0.850 | 0.070 | 0.080 | 0.000 | Amorphous phase | 1.51 | 6.0 | Good |
| Example 10 | 0.840 | 0.080 | 0.080 | 0.000 | Amorphous phase | 1.47 | 5.8 | Good |
| Example 11 | 0.820 | 0.100 | 0.080 | 0.000 | Amorphous phase | 1.37 | 5.9 | Good |
| Comparative example 5 | 0.790 | 0.130 | 0.080 | 0.000 | Amorphous phase | 1.13 | 7.4 | Good |

TABLE 3

| | $Fe_{(1-(a+b+c))}M_aP_bSi_c$ (d = e = f = 0, α = β = 0) | | | | | | | |
|---|---|---|---|---|---|---|---|---|
| Sample No. | Fe | M (Zr) a | P b | Si c | XRD | Bs (T) | Hc (A/m) | ρ |
| Comparative example 6 | 0.922 | 0.070 | 0.008 | 0.000 | Crystal phase | 1.88 | 412 | Poor |
| Example 12 | 0.920 | 0.070 | 0.010 | 0.000 | Amorphous phase | 1.73 | 9.5 | Poor |

TABLE 3-continued

| | $Fe_{(1-(a+b+c))}M_aP_bSi_c$ (d = e = f = 0, α = β = 0) | | | | | | | |
|---|---|---|---|---|---|---|---|---|
| Sample No. | Fe | M (Zr) a | P b | Si c | XRD | Bs (T) | Hc (A/m) | ρ |
| Example 13 | 0.910 | 0.070 | 0.020 | 0.000 | Amorphous phase | 1.70 | 7.1 | Fair |
| Example 14 | 0.900 | 0.070 | 0.030 | 0.000 | Amorphous phase | 1.67 | 6.4 | Good |
| Example 3 | 0.890 | 0.070 | 0.040 | 0.000 | Amorphous phase | 1.64 | 5.3 | Good |
| Example 15 | 0.860 | 0.070 | 0.070 | 0.000 | Amorphous phase | 1.59 | 5.5 | Excellent |
| Example 16 | 0.830 | 0.070 | 0.100 | 0.000 | Amorphous phase | 1.51 | 6.1 | Excellent |
| Example 17 | 0.780 | 0.070 | 0.150 | 0.000 | Amorphous phase | 1.30 | 7.9 | Excellent |
| Comparative example 7 | 0.730 | 0.070 | 0.200 | 0.000 | Amorphous phase | 1.02 | 9.7 | Excellent |

TABLE 4

| | $Fe_{(1-(a+b+c+d))}M_aP_bSi_cCu_d$ (e = f = 0, α = β = 0) | | | | | | | | |
|---|---|---|---|---|---|---|---|---|---|
| Sample No. | Fe | M (Zr) a | P b | Si c | Cu d | XRD | Bs (T) | Hc (A/m) | ρ |
| Example 3 | 0.890 | 0.070 | 0.040 | 0.000 | 0.000 | Amorphous phase | 1.64 | 5.3 | Good |
| Example 18 | 0.889 | 0.070 | 0.040 | 0.000 | 0.001 | Amorphous phase | 1.61 | 5.3 | Good |
| Example 19 | 0.885 | 0.070 | 0.040 | 0.000 | 0.005 | Amorphous phase | 1.54 | 5.1 | Good |
| Example 20 | 0.880 | 0.070 | 0.040 | 0.000 | 0.010 | Amorphous phase | 1.47 | 4.3 | Good |
| Example 21 | 0.870 | 0.070 | 0.040 | 0.000 | 0.020 | Amorphous phase | 1.34 | 4.1 | Good |
| Comparative example 8 | 0.860 | 0.070 | 0.040 | 0.000 | 0.030 | Crystal phase | 1.19 | 97 | Fair |

TABLE 5

| | $Fe_{(1-(a+b+c+e))}M_aP_bSi_cX3_e$ (d = f = 0, α = β = 0) | | | | | | | | | |
|---|---|---|---|---|---|---|---|---|---|---|
| Sample No. | Fe | M (Zr) a | P b | Si c | C e | Ge | XRD | Bs (T) | Hc (A/m) | ρ |
| Example 22 | 0.880 | 0.070 | 0.070 | 0.000 | 0.010 | 0.000 | Amorphous phase | 1.64 | 5.1 | Good |
| Example 23 | 0.840 | 0.070 | 0.070 | 0.000 | 0.050 | 0.000 | Amorphous phase | 1.55 | 5.2 | Good |
| Example 24 | 0.790 | 0.070 | 0.070 | 0.000 | 0.100 | 0.000 | Amorphous phase | 1.33 | 6.9 | Excellent |
| Comparative example 9 | 0.770 | 0.070 | 0.070 | 0.000 | 0.120 | 0.000 | Amorphous phase | 1.21 | 12.0 | Excellent |
| Example 25 | 0.880 | 0.070 | 0.070 | 0.000 | 0.000 | 0.010 | Amorphous phase | 1.62 | 5.3 | Good |
| Example 26 | 0.840 | 0.070 | 0.070 | 0.000 | 0.000 | 0.050 | Amorphous phase | 1.50 | 5.4 | Good |
| Example 27 | 0.790 | 0.070 | 0.070 | 0.000 | 0.000 | 0.100 | Amorphous phase | 1.30 | 7.8 | Good |
| Comparative example 10 | 0.770 | 0.070 | 0.070 | 0.000 | 0.000 | 0.120 | Amorphous phase | 1.14 | 13.7 | Excellent |
| Example 28 | 0.840 | 0.070 | 0.070 | 0.000 | 0.025 | 0.025 | Amorphous phase | 1.55 | 5.2 | Good |

TABLE 6

| | $Fe_{(1-(a+b+c+f))}M_aP_bSi_cB_f$ (d = e = 0, α = β = 0) | | | | | | | | |
|---|---|---|---|---|---|---|---|---|---|
| Sample No. | Fe | M (Zr) a | P b | Si c | B f | XRD | Bs (T) | Hc (A/m) | ρ |
| Example 3 | 0.890 | 0.070 | 0.040 | 0.000 | 0.000 | Amorphous phase | 1.64 | 5.3 | Good |
| Example 29 | 0.885 | 0.070 | 0.040 | 0.000 | 0.005 | Amorphous phase | 1.62 | 5.3 | Good |
| Example 30 | 0.880 | 0.070 | 0.040 | 0.000 | 0.010 | Amorphous phase | 1.57 | 6.7 | Good |
| Example 31 | 0.870 | 0.070 | 0.040 | 0.000 | 0.020 | Amorphous phase | 1.47 | 8.9 | Good |
| Comparative example 12 | 0.850 | 0.070 | 0.040 | 0.000 | 0.040 | Amorphous phase | 1.31 | 42.0 | Good |

TABLE 7

| | $Fe_{(1-(a+b+c+f))}M_aP_bSi_cB_f$ (d = e = 0, α = β = 0) | | | | | | | | |
|---|---|---|---|---|---|---|---|---|---|
| Sample No. | Fe | M (Nb) a | P b | Si c | B f | XRD | Bs (T) | Hc (A/m) | ρ |
| Example 9 | 0.850 | 0.070 | 0.080 | 0.000 | 0.000 | Amorphous phase | 1.51 | 6.0 | Good |
| Example 33 | 0.845 | 0.070 | 0.080 | 0.000 | 0.005 | Amorphous phase | 1.49 | 6.1 | Good |
| Example 34 | 0.840 | 0.070 | 0.080 | 0.000 | 0.010 | Amorphous phase | 1.45 | 6.7 | Good |
| Example 35 | 0.830 | 0.070 | 0.080 | 0.000 | 0.020 | Amorphous phase | 1.39 | 7.4 | Excellent |
| Example 36 | 0.820 | 0.070 | 0.080 | 0.000 | 0.030 | Amorphous phase | 1.30 | 9.2 | Excellent |
| Comparative example 13 | 0.810 | 0.070 | 0.080 | 0.000 | 0.040 | Amorphous phase | 1.22 | 12.8 | Excellent |

TABLE 8

| | $Fe_{(1-(a+b+c))}M_aP_bSi_c$ (d = e = f = 0, α = β = 0) | | | | | | | | | | | | |
|---|---|---|---|---|---|---|---|---|---|---|---|---|---|
| Sample No. | Fe | Zr | Hf | Nb | Ta a | W | Mo | P b | Si c | XRD | Bs (T) | Hc (A/m) | ρ |
| Example 3 | 0.890 | 0.070 | 0.000 | 0.000 | 0.000 | 0.000 | 0.000 | 0.040 | 0.000 | Amorphous phase | 1.64 | 5.3 | Good |
| Example 37 | 0.890 | 0.060 | 0.010 | 0.000 | 0.000 | 0.000 | 0.000 | 0.040 | 0.000 | Amorphous phase | 1.63 | 5.3 | Good |
| Example 38 | 0.890 | 0.060 | 0.000 | 0.010 | 0.000 | 0.000 | 0.000 | 0.040 | 0.000 | Amorphous phase | 1.61 | 5.7 | Good |
| Example 39 | 0.890 | 0.060 | 0.000 | 0.000 | 0.010 | 0.000 | 0.000 | 0.040 | 0.000 | Amorphous phase | 1.59 | 5.9 | Good |
| Example 40 | 0.890 | 0.060 | 0.000 | 0.000 | 0.000 | 0.010 | 0.000 | 0.040 | 0.000 | Amorphous phase | 1.57 | 6.3 | Good |
| Example 41 | 0.890 | 0.060 | 0.000 | 0.000 | 0.000 | 0.000 | 0.010 | 0.040 | 0.000 | Amorphous phase | 1.58 | 6.2 | Good |

TABLE 9

| | $Fe_{(1-(a+b+c))}M_aP_bSi_c$ (d = e = f = 0, α = β = 0) | | | | | | | |
|---|---|---|---|---|---|---|---|---|
| Sample No. | Fe | M (Zr) a | P b | Si c | XRD | Bs (T) | Hc (A/m) | ρ |
| Example 3 | 0.890 | 0.070 | 0.040 | 0.000 | Amorphous phase | 1.64 | 5.3 | Good |
| Example 42 | 0.890 | 0.070 | 0.039 | 0.001 | Amorphous phase | 1.69 | 3.1 | Excellent |
| Example 43 | 0.890 | 0.070 | 0.035 | 0.005 | Amorphous phase | 1.69 | 1.6 | Excellent |
| Example 44 | 0.890 | 0.070 | 0.030 | 0.010 | Amorphous phase | 1.65 | 1.6 | Excellent |
| Example 45 | 0.890 | 0.070 | 0.025 | 0.015 | Amorphous phase | 1.64 | 2.2 | Excellent |

TABLE 9-continued

| | $Fe_{(1-(a+b+c))}M_aP_bSi_c$ (d = e = f = 0, α = β = 0) | | | | | | | |
|---|---|---|---|---|---|---|---|---|
| Sample No. | Fe | M (Zr) a | P b | Si c | XRD | Bs (T) | Hc (A/m) | ρ |
| Example 46 | 0.890 | 0.070 | 0.020 | 0.020 | Amorphous phase | 1.61 | 4.1 | Excellent |
| Example 47 | 0.890 | 0.070 | 0.015 | 0.025 | Amorphous phase | 1.58 | 6.2 | Excellent |
| Example 48 | 0.890 | 0.070 | 0.010 | 0.030 | Amorphous phase | 1.57 | 9.8 | Excellent |

TABLE 10

| | $Fe_{(1-(a+b+c))}M_aP_bSi_c$ (d = e = f = 0, α = β = 0) | | | | | | | |
|---|---|---|---|---|---|---|---|---|
| Sample No. | Fe | M (Zr) a | P b | Si c | XRD | Bs (T) | Hc (A/m) | ρ |
| Example 3 | 0.890 | 0.070 | 0.040 | 0.000 | Amorphous phase | 1.64 | 5.3 | Good |
| Example 49 | 0.885 | 0.070 | 0.040 | 0.005 | Amorphous phase | 1.68 | 1.5 | Excellent |
| Example 50 | 0.880 | 0.070 | 0.040 | 0.010 | Amorphous phase | 1.65 | 1.6 | Excellent |
| Example 51 | 0.870 | 0.070 | 0.040 | 0.020 | Amorphous phase | 1.62 | 2.1 | Excellent |
| Example 52 | 0.860 | 0.070 | 0.040 | 0.030 | Amorphous phase | 1.58 | 2.3 | Excellent |
| Example 53 | 0.850 | 0.070 | 0.040 | 0.040 | Amorphous phase | 1.51 | 3.7 | Excellent |
| Example 54 | 0.840 | 0.070 | 0.040 | 0.050 | Amorphous phase | 1.35 | 4.8 | Excellent |
| Comparative example 14 | 0.820 | 0.070 | 0.040 | 0.070 | Amorphous phase | 1.24 | 7.9 | Excellent |

TABLE 11

| | $Fe_{(1-(a+b+c))}M_aP_bSi_c$ (d = e = f = 0, α = β = 0) | | | | | | | |
|---|---|---|---|---|---|---|---|---|
| Sample No. | Fe | M(Zr) a | P b | Si c | XRD | Bs (T) | Hc (A/m) | ρ |
| Example 56 | 0.930 | 0.030 | 0.035 | 0.005 | Amorphous phase | 1.87 | 8.9 | Fair |
| Example 57 | 0.910 | 0.050 | 0.035 | 0.005 | Amorphous phase | 1.79 | 3.4 | Good |
| Example 43 | 0.890 | 0.070 | 0.035 | 0.005 | Amorphous phase | 1.69 | 1.6 | Excellent |
| Example 58 | 0.880 | 0.080 | 0.035 | 0.005 | Amorphous phase | 1.64 | 1.3 | Excellent |
| Example 59 | 0.860 | 0.100 | 0.035 | 0.005 | Amorphous phase | 1.51 | 1.7 | Excellent |
| Example 60 | 0.840 | 0.120 | 0.035 | 0.005 | Amorphous phase | 1.37 | 2.1 | Excellent |
| Comparative example 15 | 0.830 | 0.130 | 0.035 | 0.005 | Amorphous phase | 1.29 | 2.8 | Excellent |

TABLE 12

| | $Fe_{(1-(a+b+c))}M_aP_bSi_c$ (d = e = f = 0, α = β = 0) | | | | | | | |
|---|---|---|---|---|---|---|---|---|
| Sample No. | Fe | M (Nb) a | P b | Si c | XRD | Bs (T) | Hc (A/m) | ρ |
| Comparative example 16 | 0.895 | 0.025 | 0.070 | 0.010 | Crystal phase | 1.80 | 315 | Fair |
| Example 61 | 0.890 | 0.030 | 0.070 | 0.010 | Amorphous phase | 1.77 | 9.7 | Good |
| Example 62 | 0.870 | 0.050 | 0.070 | 0.010 | Amorphous phase | 1.68 | 4.1 | Excellent |
| Example 63 | 0.850 | 0.070 | 0.070 | 0.010 | Amorphous phase | 1.56 | 2.4 | Excellent |

TABLE 12-continued

| | $Fe_{(1-(a+b+c))}M_aP_bSi_c$ (d = e = f = 0, α = β = 0) | | | | | | | |
|---|---|---|---|---|---|---|---|---|
| Sample No. | Fe | M (Nb) a | P b | Si c | XRD | Bs (T) | Hc (A/m) | ρ |
| Example 64 | 0.840 | 0.080 | 0.070 | 0.010 | Amorphous phase | 1.51 | 2.1 | Excellent |
| Example 65 | 0.820 | 0.100 | 0.070 | 0.010 | Amorphous phase | 1.41 | 2.2 | Excellent |
| Example 66 | 0.800 | 0.120 | 0.070 | 0.010 | Amorphous phase | 1.30 | 2.6 | Excellent |
| Comparative example 17 | 0.790 | 0.130 | 0.070 | 0.010 | Amorphous phase | 1.23 | 3.1 | Excellent |

TABLE 13

| | $Fe_{(1-(a+b+c))}M_aP_bSi_c$ (d = e = f = 0, α = β = 0) | | | | | | | |
|---|---|---|---|---|---|---|---|---|
| Sample No. | Fe | M (Zr) a | P b | Si c | XRD | Bs (T) | Hc (A/m) | ρ |
| Comparative example 18 | 0.920 | 0.070 | 0.009 | 0.001 | Crystal phase | 1.76 | 153 | Poor |
| Example 67 | 0.910 | 0.070 | 0.018 | 0.002 | Amorphous phase | 1.73 | 4.8 | Good |
| Example 68 | 0.900 | 0.070 | 0.026 | 0.004 | Amorphous phase | 1.72 | 2.6 | Excellent |
| Example 43 | 0.890 | 0.070 | 0.035 | 0.005 | Amorphous phase | 1.69 | 1.6 | Excellent |
| Example 69 | 0.870 | 0.070 | 0.052 | 0.008 | Amorphous phase | 1.66 | 1.6 | Excellent |
| Example 70 | 0.850 | 0.070 | 0.070 | 0.010 | Amorphous phase | 1.63 | 1.7 | Excellent |
| Example 71 | 0.830 | 0.070 | 0.087 | 0.013 | Amorphous phase | 1.59 | 1.9 | Excellent |
| Example 72 | 0.810 | 0.070 | 0.105 | 0.015 | Amorphous phase | 1.56 | 2.3 | Excellent |
| Example 73 | 0.780 | 0.070 | 0.131 | 0.019 | Amorphous phase | 1.50 | 4.3 | Excellent |
| Comparative example 19 | 0.750 | 0.070 | 0.157 | 0.023 | Amorphous phase | 1.38 | 12.2 | Excellent |

TABLE 14

| | $Fe_{(1-(a+b+c+d))}M_aP_bSi_cCu_d$ (e = f= 0, α = β = 0) | | | | | | | | |
|---|---|---|---|---|---|---|---|---|---|
| Sample No. | Fe | M (Zr) a | P b | Si c | Cu d | XRD | Bs (T) | Hc (A/m) | ρ |
| Example 43 | 0.890 | 0.070 | 0.035 | 0.005 | 0.000 | Amorphous phase | 1.69 | 1.6 | Excellent |
| Example 74 | 0.889 | 0.070 | 0.035 | 0.005 | 0.001 | Amorphous phase | 1.67 | 1.6 | Excellent |
| Example 75 | 0.885 | 0.070 | 0.035 | 0.005 | 0.005 | Amorphous phase | 1.61 | 1.2 | Excellent |
| Example 76 | 0.880 | 0.070 | 0.035 | 0.005 | 0.010 | Amorphous phase | 1.54 | 0.9 | Excellent |
| Example 77 | 0.870 | 0.070 | 0.035 | 0.005 | 0.020 | Amorphous phase | 1.40 | 0.8 | Good |
| Comparative example 20 | 0.860 | 0.070 | 0.035 | 0.005 | 0.030 | Amorphous phase | 1.26 | 2.5 | Good |

TABLE 15

| | $Fe_{(1-(a+b+c+e))}M_aP_bSi_cX3_e$ (d = f = 0, α = β = 0) | | | | | | | | | |
|---|---|---|---|---|---|---|---|---|---|---|
| Sample No. | Fe | M (Zr) a | P b | Si c | C | Ge e | XRD | Bs (T) | Hc (A/m) | ρ |
| Example 43 | 0.890 | 0.070 | 0.035 | 0.005 | 0.000 | 0.000 | Amorphous phase | 1.69 | 1.6 | Excellent |
| Example 78 | 0.880 | 0.070 | 0.035 | 0.005 | 0.010 | 0.000 | Amorphous phase | 1.67 | 1.5 | Excellent |

TABLE 15-continued

| | $Fe_{(1-(a+b+c+e))}M_aP_bSi_cX3_e$ (d = f = 0, α = β = 0) | | | | | | | | | |
|---|---|---|---|---|---|---|---|---|---|---|
| Sample No. | Fe | M (Zr) a | P b | Si c | C | Ge e | XRD | Bs (T) | Hc (A/m) | ρ |
| Example 79 | 0.840 | 0.070 | 0.035 | 0.005 | 0.050 | 0.000 | Amorphous phase | 1.58 | 1.7 | Excellent |
| Example 80 | 0.790 | 0.070 | 0.035 | 0.005 | 0.100 | 0.000 | Amorphous phase | 1.47 | 2.1 | Excellent |
| Example 82 | 0.880 | 0.070 | 0.035 | 0.005 | 0.000 | 0.010 | Amorphous phase | 1.65 | 1.6 | Excellent |
| Example 83 | 0.840 | 0.070 | 0.035 | 0.005 | 0.000 | 0.050 | Amorphous phase | 1.51 | 1.9 | Excellent |
| Example 84 | 0.790 | 0.070 | 0.035 | 0.005 | 0.000 | 0.100 | Amorphous phase | 1.34 | 2.5 | Excellent |
| Comparative example 21 | 0.770 | 0.070 | 0.035 | 0.005 | 0.000 | 0.120 | Amorphous phase | 1.29 | 3.7 | Excellent |
| Example 85 | 0.840 | 0.070 | 0.035 | 0.005 | 0.025 | 0.025 | Amorphous phase | 1.55 | 1.7 | Excellent |

TABLE 16

| | $Fe_{(1-(a+b+c+f))}M_aP_bSi_cB_f$ (d = e = 0, α = β = 0) | | | | | | | | |
|---|---|---|---|---|---|---|---|---|---|
| Sample No. | Fe | M (Zr) a | P b | Si c | B f | XRD | Bs (T) | Hc (A/m) | ρ |
| Example 43 | 0.890 | 0.070 | 0.035 | 0.005 | 0.000 | Amorphous phase | 1.69 | 1.6 | Excellent |
| Example 86 | 0.885 | 0.070 | 0.035 | 0.005 | 0.005 | Amorphous phase | 1.64 | 2.4 | Excellent |
| Example 87 | 0.880 | 0.070 | 0.035 | 0.005 | 0.010 | Amorphous phase | 1.59 | 3.9 | Excellent |
| Example 88 | 0.870 | 0.070 | 0.035 | 0.005 | 0.020 | Amorphous phase | 1.50 | 6.6 | Excellent |
| Example 89 | 0.860 | 0.070 | 0.035 | 0.005 | 0.030 | Amorphous phase | 1.41 | 9.7 | Excellent |
| Comparative example 22 | 0.850 | 0.070 | 0.035 | 0.005 | 0.040 | Amorphous phase | 1.32 | 15.3 | Excellent |

TABLE 17

| | $Fe_{(1-(a+b+c+f))}M_aP_bSi_cB_f$ (d = e = 0, α = β = 0) | | | | | | | | |
|---|---|---|---|---|---|---|---|---|---|
| Sample No. | Fe | M (Hf) a | P b | Si c | B f | XRD | Bs (T) | Hc (A/m) | ρ |
| Example 90 | 0.890 | 0.070 | 0.035 | 0.005 | 0.000 | Amorphous phase | 1.68 | 1.7 | Excellent |
| Example 91 | 0.885 | 0.070 | 0.035 | 0.005 | 0.005 | Amorphous phase | 1.63 | 2.4 | Excellent |
| Example 92 | 0.880 | 0.070 | 0.035 | 0.005 | 0.010 | Amorphous phase | 1.57 | 4.1 | Excellent |
| Example 93 | 0.870 | 0.070 | 0.035 | 0.005 | 0.020 | Amorphous phase | 1.49 | 6.9 | Excellent |
| Example 94 | 0.860 | 0.070 | 0.035 | 0.005 | 0.030 | Amorphous phase | 1.40 | 9.7 | Excellent |
| Comparative example 23 | 0.850 | 0.070 | 0.035 | 0.005 | 0.040 | Amorphous phase | 1.33 | 14.7 | Excellent |

TABLE 18

| | $Fe_{(1-(a+b+c+f))}M_aP_bSi_cB_f$ (d = e = 0, α = β = 0) | | | | | | | | |
|---|---|---|---|---|---|---|---|---|---|
| Sample No. | Fe | M (Nb) a | P b | Si c | B f | XRD | Bs (T) | Hc (A/m) | ρ |
| Example 63 | 0.850 | 0.070 | 0.070 | 0.010 | 0.000 | Amorphous phase | 1.56 | 2.4 | Excellent |
| Example 96 | 0.845 | 0.070 | 0.070 | 0.010 | 0.005 | Amorphous phase | 1.54 | 2.8 | Excellent |
| Example 97 | 0.840 | 0.070 | 0.070 | 0.010 | 0.010 | Amorphous phase | 1.54 | 4.5 | Excellent |

TABLE 18-continued

| | $Fe_{(1-(a+b+c+f))}M_aP_bSi_cB_f$ (d = e = 0, α = β = 0) | | | | | | | | |
|---|---|---|---|---|---|---|---|---|---|
| Sample No. | Fe | M (Nb) a | P b | Si c | B f | XRD | Bs (T) | Hc (A/m) | ρ |
| Example 98 | 0.830 | 0.070 | 0.070 | 0.010 | 0.020 | Amorphous phase | 1.45 | 7.3 | Excellent |
| Example 99 | 0.820 | 0.070 | 0.070 | 0.010 | 0.030 | Amorphous phase | 1.37 | 9.9 | Excellent |
| Comparative example 24 | 0.810 | 0.070 | 0.070 | 0.010 | 0.040 | Amorphous phase | 1.28 | 18.0 | Excellent |

TABLE 19

| | $Fe_{(1-(\alpha+\beta))}X1_\alpha X2_\beta$ (a to c are same as Example 43, d = e = f = 0) | | | | | | |
|---|---|---|---|---|---|---|---|
| | X1 | | X2 | | | Bs | Hc |
| Sample No. | Type | a{1 − (a + b + c)} | Type | β{1 − (a + b + c)} | XRD | (T) | (A/m) |
| Example 43 | — | 0.000 | — | 0.000 | Amorphous phase | 1.69 | 1.6 |
| Example 100 | Co | 0.010 | — | 0.000 | Amorphous phase | 1.70 | 2.2 |
| Example 101 | Co | 0.100 | — | 0.000 | Amorphous phase | 1.75 | 3.6 |
| Example 102 | Co | 0.500 | — | 0.000 | Amorphous phase | 1.84 | 9.8 |
| Comparative example 25 | Co | 0.600 | — | 0.000 | Amorphous phase | 1.88 | 18.3 |
| Example 103 | Ni | 0.010 | — | 0.000 | Amorphous phase | 1.65 | 1.8 |
| Example 104 | Ni | 0.100 | — | 0.000 | Amorphous phase | 1.52 | 2.7 |
| Example 105 | Ni | 0.500 | — | 0.000 | Amorphous phase | 1.31 | 6.3 |
| Example 106 | — | 0.000 | V | 0.030 | Amorphous phase | 1.62 | 2.1 |
| Example 107 | — | 0.000 | Mn | 0.030 | Amorphous phase | 1.60 | 3.7 |
| Example 108 | — | 0.000 | Zn | 0.030 | Amorphous phase | 1.65 | 3.4 |
| Example 109 | — | 0.000 | Al | 0.030 | Amorphous phase | 1.66 | 2.1 |
| Example 110 | — | 0.000 | Sn | 0.030 | Amorphous phase | 1.64 | 2.3 |
| Example 111 | — | 0.000 | La | 0.030 | Amorphous phase | 1.55 | 2.6 |
| Example 112 | Co | 0.100 | Zn | 0.030 | Amorphous phase | 1.69 | 4.1 |

TABLE 20

| | Compositions are same as Example 3 | | | | | | | |
|---|---|---|---|---|---|---|---|---|
| Sample No. | Rotatioanl speed of roll (m/sec.) | Heat treatment temperature (° C.) | Heat treatment time (min) | Average grain size of initial fine crystal (nm) | Average grain size of Fe-based nanocrystal alloy (nm) | XRD | Bs (T) | Hc (A/m) |
| Example 113 | 55 | 550 | 60 | No initial fine crystal | 8 | Amorphous phase | 1.65 | 5.2 |
| Example 114 | 40 | 550 | 10 | 0.3 | 8 | Amorphous phase | 1.54 | 6.1 |
| Example 3 | 40 | 550 | 60 | 0.3 | 10 | Amorphous phase | 1.64 | 5.3 |
| Example 115 | 40 | 550 | 120 | 0.3 | 20 | Amorphous phase | 1.67 | 6.5 |
| Example 116 | 40 | 550 | 180 | 0.3 | 20 | Amorphous phase | 1.70 | 7.9 |
| Example 117 | 40 | 600 | 180 | 0.3 | 30 | Amorphous phase | 1.71 | 9.5 |
| Example 118 | 30 | 550 | 60 | 10.0 | 20 | Amorphous phase | 1.62 | 5.8 |

TABLE 20-continued

| Sample No. | Compositions are same as Example 3 | | | | | | | |
|---|---|---|---|---|---|---|---|---|
| | Rotatioanl speed of roll (m/sec.) | Heat treatment temperature (° C.) | Heat treatment time (min) | Average grain size of initial fine crystal (nm) | Average grain size of Fe-based nanocrystal alloy (nm) | XRD | Bs (T) | Hc (A/m) |
| Comparative example 26 | 20 | 550 | 60 | 20.0 | 100 | Crystal phase | 1.66 | 370 |

TABLE 21

| Sample No. | Compositions are same as Example 43 | | | | | | | |
|---|---|---|---|---|---|---|---|---|
| | Rotatioanl speed of roll (m/sec.) | Heat treatment temperature (° C.) | Heat treatment time (min) | Average grain size of initial fine crystal (nm) | Average grain size of Fe-based nanocrystal alloy (nm) | XRD | Bs (T) | Hc (A/m) |
| Example 119 | 55 | 550 | 60 | No initial fine crystal | 8 | Amorphous phase | 1.67 | 1.5 |
| Example 120 | 40 | 550 | 10 | 0.3 | 5 | Amorphous phase | 1.55 | 3.4 |
| Example 43 | 40 | 550 | 60 | 0.3 | 8 | Amorphous phase | 1.69 | 1.6 |
| Example 121 | 40 | 550 | 120 | 0.3 | 10 | Amorphous phase | 1.70 | 2.2 |
| Example 122 | 40 | 550 | 180 | 0.3 | 20 | Amorphous phase | 1.71 | 2.9 |
| Example 123 | 40 | 600 | 180 | 0.3 | 30 | Amorphous phase | 1.72 | 6.2 |
| Example 124 | 30 | 550 | 60 | 10.0 | 20 | Amorphous phase | 1.68 | 1.9 |
| Comparative example 27 | 20 | 550 | 60 | 20.0 | 80 | Crystal phase | 1.70 | 190 |

Table 1 shows Examples and Comparative examples wherein M was Zr only; and Si, Cu, X3, and B were not included while Zr content (a) was varied.

Examples 1 to 6 in which a content of each component was within the predetermined range had good saturation magnetic flux density Bs and coercive force Hc.

On the contrary to this, regarding Comparative example 1 in which Zr content was too small, the thin ribbon before the heat treatment was made of crystal phases; and the coercive force Hc after the heat treatment increased significantly and the resistivity p decreased. Also, Comparative example 2 in which Zr content was too large had a decreased saturation magnetic flux density.

Table 2 shows Examples and Comparative examples wherein M was Nb only; and Si, Cu, X3, and B were not included while Nb content (a) was varied.

Examples 7 to 11 in which a content of each component was within the predetermined range had good saturation magnetic flux density Bs and coercive force Hc.

On the contrary to this, regarding Comparative example 3 in which Nb content was too small, the thin ribbon before the heat treatment was made of crystal phases; and the coercive force Hc after the heat treatment increased significantly and the resistivity p decreased. Also, Comparative example 5 in which Zr content was too large had a decreased saturation magnetic flux density.

Table 3 shows Examples and Comparative examples wherein M was Zr only; and Si, Cu, X3, and B were not included while P content (b) was varied.

Examples 12 to 17 in which a content of each component was within the predetermined range had good saturation magnetic flux density Bs and coercive force Hc.

On the contrary to this, regarding Comparative example 6 in which P content was too small, the thin ribbon before the heat treatment was made of crystal phases; and the coercive force Hc after the heat treatment increased significantly and the resistivity p decreased. Also, Comparative example 7 in which P content was too large had a decreased saturation magnetic flux density Bs.

Table 4 shows Examples and Comparative examples in which M was Zr only; and Si, Cu, X3, and B were not included while Cu content (d) was varied.

Examples 18 to 21 in which a content of each component was within the predetermined range had good saturation magnetic flux density Bs and coercive force Hc.

On the contrary to this, regarding Comparative example 8 in which Cu content was too small, the thin ribbon before the heat treatment was made of crystal phases; and the coercive force Hc after the heat treatment increased significantly. Further, the saturation magnetic flux density Bs decreased.

Table 5 shows Examples and Comparative examples in which M was Zr only; and Si, Cu, and B were not included while a type and content (e) of X3 were varied.

Examples 22 to 28 in which a content of each component was within the predetermined range had good saturation magnetic flux density Bs, coercive force Hc, and resistivity p.

On the contrary to this, regarding Comparative examples 9 and 10 in which X3 content was too large, the saturation magnetic flux density Bs decreased and the coercive force Hc increased.

Table 6 shows Examples and Comparative examples wherein M was Zr only; and Si, Cu, and X3 were not included while B content (f) was varied.

Examples 29 to 31 in which a content of each component was within the predetermined range had good saturation magnetic flux density Bs, coercive force Hc, and resistivity ρ.

On the contrary to this, Comparative example 12 in which B content was too large had an increased coercive force Hc.

Table 7 shows Examples and Comparative examples wherein M was Nb only; and Si, Cu, and X3 were not included while B content (f) was varied.

Examples 33 to 36 in which a content of each component was within the predetermined range had good saturation magnetic flux density Bs, coercive force Hc, and resistivity ρ.

On the contrary to this, Comparative example 13 in which B content was too large had a decreased saturation magnetic flux density Br decreased and an increased coercive force Hc.

Table 8 shows Examples in which a type of M was changed from Example 3.

Examples 37 to 41 in which a content of each component was within the predetermined range had good saturation magnetic flux density Bs, coercive force Hc, and resistivity p even when the type of M was changed.

Table 9 shows Examples and Comparative examples in which M was Zr only; and Cu, X3, and B were not included while a sum of P content (b) and Si content (c) was maintained constant and changed the ratio between P and Si.

Examples 42 to 48 in which a content of each component was within the predetermined range had good saturation magnetic flux density Bs, coercive force Hc, and resistivity p. Particularly, Examples 42 to 46 in which b≥c was satisfied had better saturation magnetic flux density Br and coercive force Hc compared to Examples 47 and 48 in which b and c were b<c.

Table 10 shows Examples and Comparative examples in which M was Zr only; and Cu, X3, and B were not included while Si content (c) was varied.

Examples 49 to 54 in which a content of each component was within the predetermined range had good saturation magnetic flux density Bs, coercive force Hc, and resistivity ρ.

On the contrary to this, Comparative example 14 in which Si content was too large had decreased saturation magnetic flux density Bs.

Table 11 shows Examples and Comparative examples in which M was Zr only; and Cu, X3, and B were not included while Zr content (a) was varied.

Examples 56 to 60 in which the content of each component was within the predetermined range had good saturation magnetic flux density Bs, coercive force Hc, and resistivity ρ.

On the contrary to this, Comparative example 15 in which Zr content was too large had decreased saturation magnetic flux density Bs.

Table 12 shows Examples and Comparative examples in which M was Nb only; and Cu, X3, and B were not included while Nb content (a) was varied.

Examples 61 to 66 in which the content of each component was within the predetermined range had good saturation magnetic flux density Bs, coercive force Hc, and resistivity ρ.

On the contrary to this, regarding Comparative example 16 in which Nb content was too small, the thin ribbon before the heat treatment was made of crystal phases and the coercive force Hc after the heat treatment increased significantly. Also, Comparative example 17 in which Nb content was too large had decreased saturation magnetic flux density Bs.

Table 13 shows Examples and Comparative examples in which M was Zr only; and Cu, X3, and B were not included while P content (b) and Si content (c) were varied at the same time.

Examples 67 to 73 in which a content of each component was within the predetermined range had good saturation magnetic flux density Bs, coercive force Hc, and resistivity ρ.

On the contrary to this, regarding Comparative example 18 in which P content was too small, the thin ribbon before the heat treatment was made of crystal phases; and the coercive force Hc after the heat treatment increased significantly. Further, the resistivity p decreased. Also, Comparative example 17 in which Zr content was too large had increased coercive force Hc.

Table 14 shows Examples and Comparative examples in which M was Zr only; and X3 and B were not included while Cu content (d) was varied.

Examples 74 to 77 in which a content of each component was within the predetermined range had good saturation magnetic flux density Bs, coercive force Hc, and resistivity ρ.

On the contrary to this, Comparative example 20 in which Cu content was too large had a decreased saturation magnetic flux density Bs.

Table 15 shows Examples and Comparative examples in which M was Zr only; and Cu and B were not included while a type and a content of X3 (e) were varied.

Examples 78 to 85 in which the content of each component was within the predetermined range had good saturation magnetic flux density Bs, coercive force Hc, and resistivity ρ.

On the contrary to this, Comparative example 21 in which X3 content was too large had a decreased saturation magnetic flux density Bs.

Table 16 shows Examples and Comparative examples in which M was Zr only; and Cu and X3 were not included while B content (f) was varied.

Examples 86 to 89 in which a content of each component was within the predetermined range had good saturation magnetic flux density Bs, coercive force Hc, and resistivity ρ.

On the other hand, Comparative example 22 in which B content was too large had an increased coercive force Hc.

Table 17 shows Examples and Comparative examples in which M was Hf only; and Cu and X3 were not included while B content (f) was varied.

Examples 90 to 94 in which a content of each component was within the predetermined range had good saturation magnetic flux density Bs, coercive force Hc, and resistivity ρ.

On the other hand, Comparative example 23 in which B content was too large had an increased coercive force Hc.

Table 18 shows Examples and Comparative examples in which M was Hf only; and Cu and X3 were not included while B content (f) was varied.

Examples 96 to 99 in which a content of each component was within the predetermined range had good saturation magnetic flux density Bs, coercive force Hc, and resistivity ρ.

On the other hand, Comparative example 24 in which B content was too large had increased coercive force Hc.

Table 19 shows Examples in which part of Fe of Example 43 was substituted by X1 and/or X2.

Good properties were obtained even when part of Fe was substituted by X1 and/or X2. However, Comparative example 25 in which $\alpha+\beta$ was larger than 0.50 had an increased coercive force.

Table 20 shows Examples and Comparative examples which varied an average grain size of the initial fine crystals and the average grain size of Fe-based nanocrystal alloy by changing a rotational speed of a roll, a heat treatment temperature, and/or heat treatment time of Example 3. Table 21 shows Examples which varied an average grain size of the initial fine crystals and the average grain size of Fe-based nanocrystal alloy by changing a rotational speed of a roll, a heat treatment temperature, and/or heat treatment time of Example 43.

Good properties were obtained even when the average particle size of the initial fine crystals and the average grain size of the Fe-based nanocrystal alloy were changed if a crystal having a particle size larger than 15 nm was not included in the thin ribbon of before the heat treatment. On the contrary to this, if the crystal having a particle size larger than 15 nm was included in the thin ribbon of before the heat treatment, that is in case the thin ribbon was formed of crystal phases, then the average grain size of the Fe-nano crystal of after the heat treatment increased significantly and the coercive force increased significantly.

What is claimed is:

1. A soft magnetic alloy represented by a compositional formula $(Fe_{(1-(\alpha+\beta))}X1_{\alpha}X2_{\beta})_{(1-(a+b+c+d++e+f)}M_aP_bSi_cCu_dX3_eB_f$ having a structure including Fe-based nanocrystals, in which X1 represents one or more selected from a group consisting of Co and Ni, X2 represents one or more selected from a group consisting of V, Mn, Zn, Al, Sn, and La, X3 represents one or more selected from a group consisting of C and Ge, M represents one or more selected from a group consisting of Zr, Nb, Hf, Ta, Mo, and W, $030 \le a \le 0.120$, $0.010 \le b \le 0.150$, $0 \le c \le 0.050$, $0 \le d \le 0.020$, $0 \le e \le 0.100$, $0 \le f \le 0.020$, $0 \le \alpha\{1-(a+b+c+d+e+f)\} \le 0.500$, $0 \le \beta\{1-(a+b+c+d+e+f)\} \le 0.30$, $0 \le \alpha+\beta \le 0.55$ are satisfied, and an average grain size of the Fe-based nanocrystals is 5 to 30 nm.

2. The soft magnetic alloy according to claim 1, wherein $b \ge c$ is satisfied.

3. The soft magnetic alloy according to claim 1, wherein $0 \le f \le 0.010$ is satisfied.

4. The soft magnetic alloy according to claim 1, wherein $0 \le f < 0.001$ is satisfied.

5. The soft magnetic alloy according to claim 1, wherein $0.730 \le 1-(a+b+c+d+e+f) \le 0.930$ is satisfied.

6. The soft magnetic alloy according to claim 1, wherein $0 \le \alpha\{1-(a+b+c+d+e+f)\} \le 0.40$ is satisfied.

7. The soft magnetic alloy according to claim 1, wherein $\alpha=0$ is satisfied.

8. The soft magnetic alloy according to claim 1, wherein $\beta=0$ is satisfied.

9. The soft magnetic alloy according to claim 1, wherein $\alpha=\beta=0$ is satisfied.

10. The soft magnetic alloy according to claim 1 having a thin ribbon form, wherein a thickness of the thin ribbon is 5 to 30 μm.

11. The soft magnetic alloy according to claim 1 having a powder form.

12. A magnetic component comprising the soft magnetic alloy according to claim 1.

13. A soft magnetic alloy represented by a compositional formula $(Fe_{(1-(\alpha+\beta))}X1_{\alpha}X2_{\beta})_{(1-(a+b+c+d++e+f)}M_aP_bSi_cCu_dX3_eB_f$ having a nano-hetero structure in which fine crystals are in an amorphous material, in which X1 represents one or more selected from a group consisting of Co and Ni, X2 represents one or more selected from a group consisting of V, Mn, Zn, Al, Sn, and La, X3 represents one or more selected from a group consisting of C and Ge, M represents one or more selected from a group consisting of Zr, Nb, Hf, Ta, Mo, and W, $030 \le a \le 0.120$, $0.010 \le b \le 0.150$, $0 \le c \le 0.050$, $0 \le d \le 0.020$, $0 \le e \le 0.100$, $0 \le f \le 0.020$, $0 \le \alpha\{1-(a+b+c+d+e+f)\} \le 0.500$, $0 \le \beta\{1-(a+b+c+d+e+f)\} \le 0.30$, and $0 \le \alpha+\beta \le 0.55$ are satisfied, and an average grain size of the fine crystals is 0.3 to 10 nm.

14. A soft magnetic alloy represented by a compositional formula $(Fe_{(1-(\alpha+\beta))}X1_{\alpha}X2_{\beta})_{(1-(a+b+c+d++e+f)}M_aP_bSi_cCu_dX3_eB_f$, in which X1 represents one or more selected from a group consisting of Co and Ni, X2 represents one or more selected from a group consisting of V, Mn, Zn, Al, Sn, and La, X3 represents one or more selected from a group consisting of C and Ge, M represents one or more selected from a group consisting of Zr, Nb, Hf, Ta, Mo, and W, $0.030 \le a \le 0.120$, $0.010 \le b \le 0.150$, $0 \le c \le 0.050$, $0 \le d \le 0.020$, $0 \le e \le 0.100$, $0 \le f \le 0.020$, $0 \le \alpha\{1-(a+b+c+d+e+f)\} \le 0.500$, $0 \le \beta\{1-(a+b+c+d+e+f)\} \le 0.030$, and $0 \le \alpha+\beta \le 0.55$ are satisfied, and the alloy is in amorphous form.

* * * * *